US007449825B2

(12) United States Patent
Chen et al.

(10) Patent No.: US 7,449,825 B2
(45) **Date of Patent: *Nov. 11, 2008**

(54) DOUBLE-FACED FIELD EMISSION DISPLAY DEVICE

(75) Inventors: Pi-Jin Chen, Beijing (CN); Peng Liu, Beijing (CN); Li Qian, Beijing (CN); Yang Wei, Beijing (CN); Lei-Mei Sheng, Beijing (CN); You-Hua Lei, Beijing (CN); Liang Liu, Bejing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 636 days.

This patent is subject to a terminal disclaimer.

(21) Appl. No.: 11/115,455

(22) Filed: Apr. 27, 2005

(65) Prior Publication Data

US 2005/0194889 A1 Sep. 8, 2005

(30) Foreign Application Priority Data

Jun. 2, 2004 (CN) ..... 2004 1 0027523

(51) Int. Cl.
*H01J 1/62* (2006.01)

(52) U.S. Cl. ..... 313/495; 313/302; 313/303

(58) Field of Classification Search ..... 313/495–497, 313/302, 303
See application file for complete search history.

(56) References Cited

U.S. PATENT DOCUMENTS

| | | | | |
|---|---|---|---|---|
| 5,896,575 | A * | 4/1999 | Higginbotham et al. | 455/566 |
| 6,611,094 | B2 * | 8/2003 | Ogawa et al. | 313/496 |
| 6,697,083 | B1 * | 2/2004 | Yoon | 345/658 |
| 6,777,869 | B2 * | 8/2004 | Pavlovsky | 313/496 |
| 7,327,335 | B2 * | 2/2008 | Yamazaki et al. | 345/76 |
| 2003/0193288 | A1 * | 10/2003 | Pavlovsky | 313/506 |
| 2005/0280366 | A1 * | 12/2005 | Chen et al. | 313/582 |
| 2007/0222363 | A1 * | 9/2007 | Qian et al. | 313/496 |

FOREIGN PATENT DOCUMENTS

CN 1355548 A 6/2002

* cited by examiner

*Primary Examiner*—Peter Macchiarolo
(74) *Attorney, Agent, or Firm*—Morris, Manning & Martin LLP; Tim Tingkang Xia

(57) ABSTRACT

A double-faced field emission display device includes two parallel fluorescent screens (10, 10') and an electron emission structure (20) located between the fluorescent screens. Each fluorescent screen includes a transparent substrate (21, 21') with an anode plate (12, 12') and coplanar fluorescent layers (13, 13') formed at an inner surface of the transparent substrate. The electron emission structure includes an opaque insulative substrate (28) with cathode plates (26, 26'), electron emitters (27, 27') and grid plates (25, 25') formed at each of opposite surfaces (281, 282) thereof. Symmetrically opposite pairs of same electrodes are electrically interconnected so that the fluorescent screens can simultaneous display a same image. Only a single driving system is needed to achieve the simultaneous display.

11 Claims, 2 Drawing Sheets

DOUBLE-FACED FIELD EMISSION DISPLAY DEVICE

BACKGROUND OF THE INVENTION

1. Field of the Invention

The invention relates generally to double-faced display devices, and more particularly to double-faced field emission display devices.

2. Prior Art

A field emission display device has been widely used in computers, mobile communications and consumer electronics. Conventionally, the field emission display device comprises a fluorescent screen and an electron emission structure. The fluorescent screen comprises an anode plate formed thereat, and the electron emission structure comprises a cathode plate formed thereat. In use, when an emitting voltage is applied between the anode plate and the cathode plate, electrons are emitted from the cathode plate and bombard the fluorescent screen, whereby visible light is produced and an image is displayed on the fluorescent screen. The field emission display device only displays a single image at one surface thereof.

In certain applications, a field emission display device is required to simultaneously display the same image at two opposite surfaces thereof. In order to meet such needs, it is commonplace to simply combine a pair of field emission display devices and thus form a two-sided field emission display device assembly. In the field emission display device assembly, two driving systems are needed. Furthermore, a structure of the field emission display device assembly is complicated. Thus, the field emission display device assembly is bulky and costly.

In order to solve the above-mentioned problems, a so-called double-faced field emission display device has been developed. Referring to FIG. 4, the double-faced field emission display device comprises a pair of parallel fluorescent screens 3, and a cathode plate located between the fluorescent screens 3. Each fluorescent screen 3 acts as an anode plate, and is electrically connected with an anode lead 1. The cathode plate is electrically with a cathode lead 5, and has a plurality of silicon point arrays 2 formed at opposite surfaces thereof. In use, when an emitting voltage is applied between each fluorescent screen 3 and the cathode plate, the silicon point arrays 2 emit electrons. The electrons bombard the fluorescent screen 3, whereby an image is displayed on the fluorescent screen 3.

However, a distance between the cathode plate and each fluorescent screen 3 is in a range from 2 to 30 micrometers. Thus, the emitting voltage needs to be relatively high. In addition, the emission of the electrons cannot be controlled very accurately. Furthermore, a pair of emitting spaces is defined between the cathode plate and the fluorescent screens 3 respectively, with the emitting spaces being independent of each other. This means that when the double-faced field emission display device is manufactured, the emitting spaces must be separately evacuated. Furthermore, the images displayed at the two fluorescent layers 3 may not be identical.

A double-faced field emission display device which overcomes the above-mentioned problems is desired.

SUMMARY OF THE INVENTION

Accordingly, an object of the present invention is to provide a double-faced field emission display device having a simple structure, small bulk, and low cost.

To achieve the above-mentioned object, the present invention provides a double-faced field emission display device comprising two parallel fluorescent screens and an electron emission structure located between the fluorescent screens. Each fluorescent screen comprises a transparent substrate with an anode plate and a plurality of coplanar fluorescent layers formed at an inner surface of the transparent substrate. The fluorescence layers comprise three primary colors, such as red, green and blue. The electron emission structure comprises an opaque insulative substrate having two opposite surfaces. Each surface generally faces corresponding fluorescent screen. A plurality of cathode plates and a plurality of insulative layers are alternately formed on each surface of the opaque insulative substrate. Each cathode plate has an electron emitter formed thereon, and each insulative layer has a grid plate formed thereon. The cathode plates and the grid plates are symmetrically interconnected respectively and a single driving system is adopted to achieve simultaneous display same images at the two fluorescent screens.

When the cathode plates are regarded as row electrodes, the grid plates are regarded as column electrodes. Conversely, when the grid plates are regarded as row electrodes, the cathode plates are regarded as column electrodes. Each pair of row electrodes which are symmetrical to the opaque insulative substrate are electrically interconnected. Each pair of column electrodes which are axially symmetrical to a center of the opaque insulative substrate are electrically interconnected. Furthermore, a single driving system is applied in the field emission display device to achieve simultaneous display same images at the two fluorescent screens.

Compared with a conventional double-faced field emission display device, the double-faced field emission display device of the present invention adopts a pair of fluorescent screens and a single driving system to simultaneously display same images at the two fluorescent screens. Furthermore, a plurality of grid plates are adopted, so that the emitting voltage is low and the emission of the electrons can be controlled accurately. The double-faced field emission display device of the present invention has a simple structure, small bulk and low cost, and can be advantageously applied in traffic signal boards, large-scale display boards, surround cinemas and so on.

Other objects, advantages and novel features of the invention will become more apparent from the following detailed description when taken in conjunction with the accompanying drawing, in which:

DETAILED DESCRIPTION OF THE INVENTION

Figure 1:
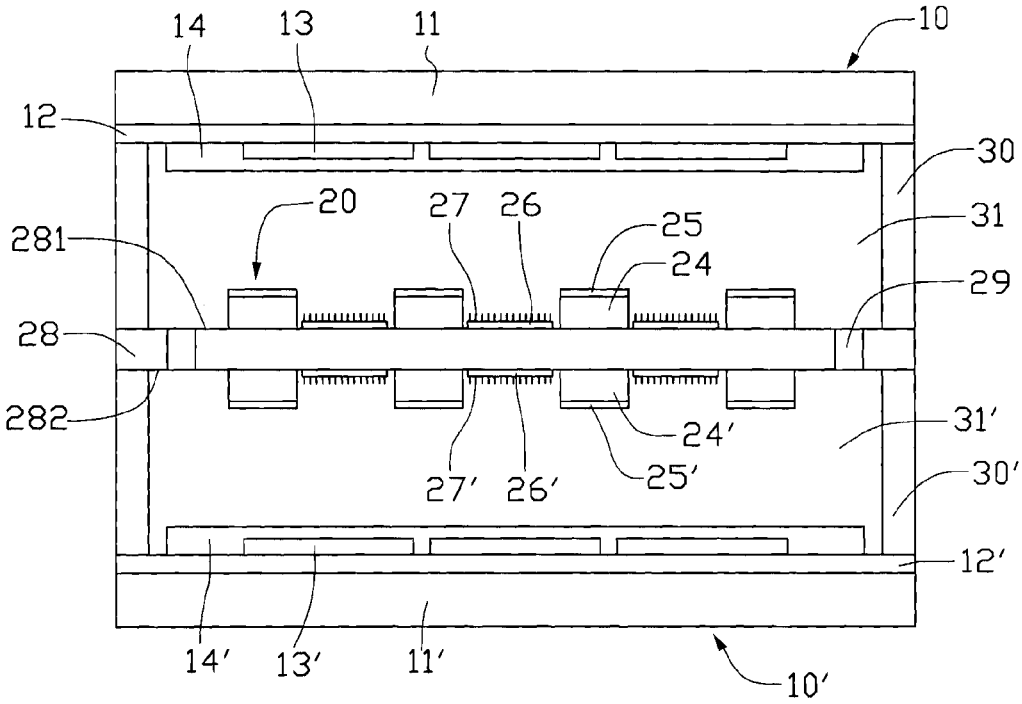
FIG. 1 is a schematic, side plan view of a double-faced field emission display device of the present invention.

Referring to FIG. 1, a double-faced field emission display device (not labeled) of the present invention comprises two parallel fluorescent screens 10, 10', and an electron emission structure 20 located between the fluorescent screens 10, 10'. The fluorescent screen 10 comprises a transparent substrate 11, with an anode plate 12, a plurality of coplanar fluorescent layers 13, and an aluminum film 14 formed at an inner surface (not labeled) of the transparent substrate 10. The anode plate 12 is formed on the inner surface of the transparent substrate 10. The fluorescent layers 13 are coated on the anode plate 12. The aluminum film 14 covers the fluorescent layers 13. The fluorescent layers 13 comprise three primary colors, such as red, green and blue. The fluorescent screen 10' has substantially the same structure as that of the fluorescent screen 10. The fluorescent screen 10' comprises a transparent substrate 11', with an anode plate 12', a plurality of coplanar fluorescent layers 13', and an aluminum film 14' formed at an inner surface (not labeled) of the transparent substrate 10'. The anode plate 12' is formed on the inner surface of the transparent substrate 10'. The fluorescent layers 13' are coated on the anode plate 12'. The aluminum film 14' covers the fluorescent layers 13'. The fluorescent layers 13' comprise three primary colors, such as red, green and blue.

The electron emission structure 20 comprises an opaque insulative substrate 28 defining a central plane of the structure 20 and having two opposite surfaces 281, 282. The surface 281 generally faces the fluorescent screen 10, and the surface 282 generally faces the fluorescent screen 10'. A plurality of cathode plates 26 and a plurality of insulative layers 24 are alternately formed on the surface 281 of the opaque insulative substrate 28. Each cathode plate 26 has an electron emitter 27 formed thereon, and each insulative layer 24 has a grid plate 25 formed thereon. Each electron emitter 27 generally faces the fluorescent layer 13, and is made of carbon nanotubes, metal or a semiconductive material. In the preferred embodiment, the electron emitters 27 are made of carbon nanotubes. Each carbon nanotube has a small tip. This facilitates point discharging of electrons, and reduces an emitting voltage required for emitting the electrons. Similarly, a plurality of cathode plates 26' and a plurality of insulative layers 24' are alternately formed on the surface 281' of the opaque insulative substrate 28'. Each cathode plate 26' has an electron emitter 27' formed thereon, and each insulative layer 24' has a grid plate 25' formed thereon. Each electron emitter 27' generally faces the fluorescent layer 13', and is made of carbon nanotubes, metal or a semiconductive material. In the preferred embodiment, the electron emitters 27' are made of carbon nanotubes.

The fluorescent screen 10 and the electron emission structure 20 define an emitting space 31 therebetween, and the fluorescent screen 10' and the electron emission structure 20 define an emitting space 31' therebetween. Four side walls 30 surround and enclose the emitting space 31, and four side walls 30' surround and enclose the emitting space 31'. With the opaque insulative substrate 28, the emitting space 31 and the emitting space 31' are independent of each other. Furthermore, four through holes 29 are defined in four corners of the opaque insulative substrate 28. Thus, the emitting space 31 and the emitting space 31' can be evacuated simultaneously.

For the fluorescent screen 10, there are two kinds of electrode configurations possible. The first configuration is: the cathode plates 26 are regarded as row electrodes, and the grid plates 25 are regarded as column electrodes. The second configuration is: the grid plates 25 are regarded as row electrodes, and the cathode plates 26 are regarded as column electrodes. The interconnections of the electrodes 25, 26 in the two configurations are similar. In the preferred embodiment, the first configuration is adopted. Similarly, for the fluorescent screen 10', a configuration analogous to the first configuration is adopted for the grid plates 25' and the cathode plates 26'.

Figure 2:
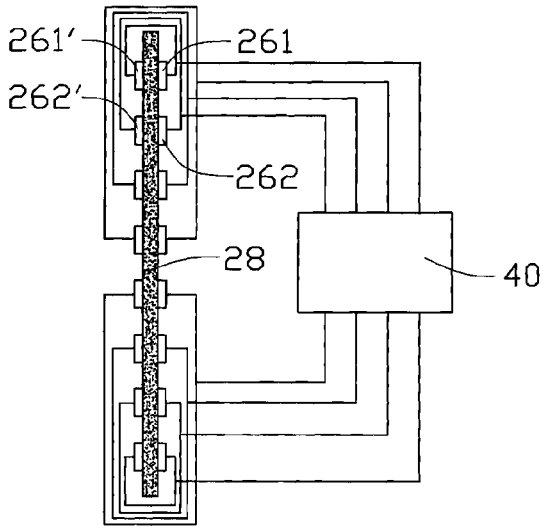
FIG. 2 is essentially a schematic, side plan diagram of an opaque insulative substrate and cathode plates of the display device of FIG. 1, showing these parts tilted to a vertical orientation, and showing connections of the cathode plates when they are regarded as row electrodes.
Figure 3:
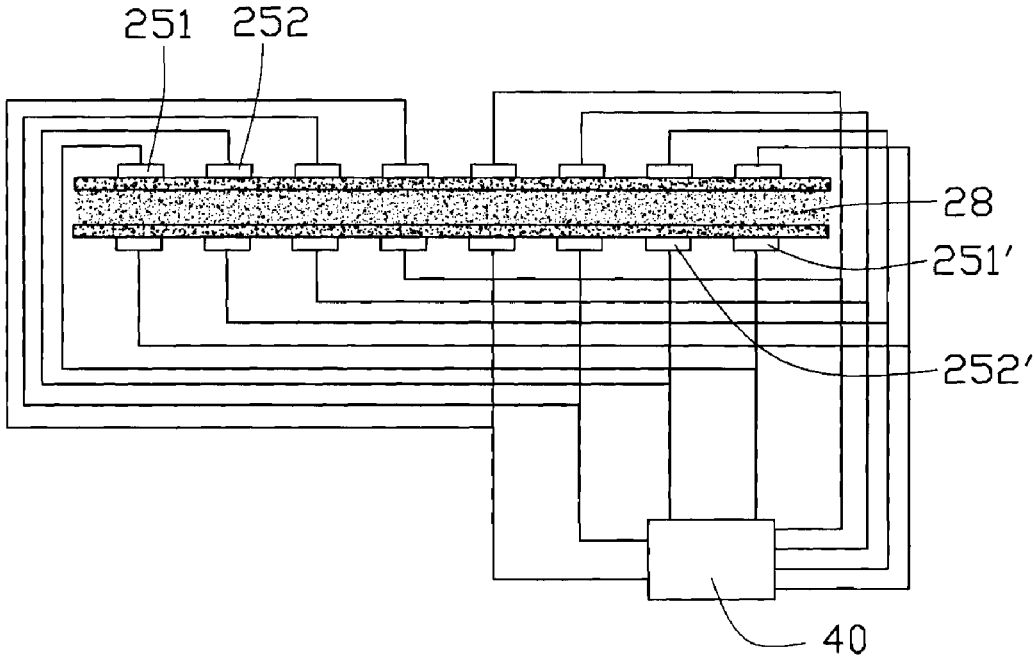
FIG. 3 is essentially a schematic, side plan diagram of the opaque insulative substrate and grid plates of the display device of FIG. 1, showing connections of the grid plates when they are regarded as column electrodes.
Figure 4:
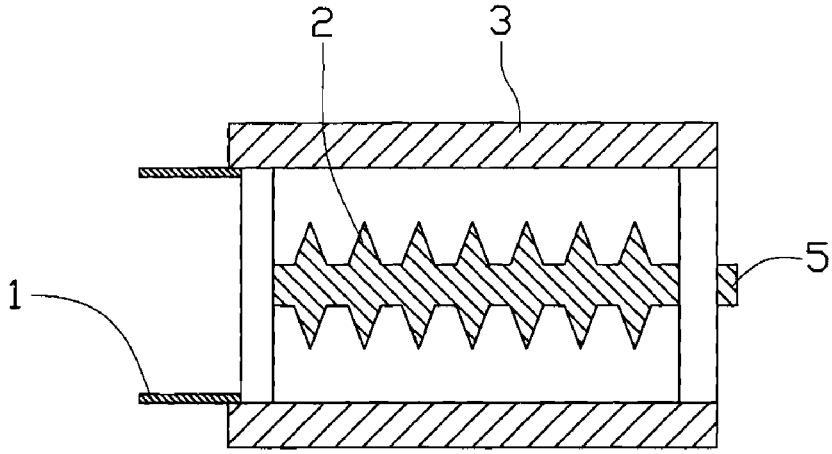
FIG. 4 (PRIOR ART)
FIG. 4 is a schematic, cross-sectional view of a conventional double-faced field emission display device.

FIG. 2 is a schematic diagram showing connections of row cathode plates 26, 26'. The cathode plates 26, 26' at a first row which are symmetrical to the opaque insulative substrate 28 are labeled as 261, 261', and the cathode plates 26, 26' at a second row which are symmetrical to the opaque insulative substrate 28 are labeled as 262, 262'. The cathode plates 261, 261' are electrically interconnected, and the cathode plates 262, 262' are electrically interconnected. Similarly, other cathode plates 26, 26' at same rows which are symmetrical to the opaque insulative substrate 28 are electrically interconnected. FIG. 3 is a schematic diagram showing connections of column grid plates 25, 25'. A first pair of column grid plates 25, 25' which are axially symmetrical to a center of the opaque insulative substrate 28 are labeled as 251, 251', and a second pair of column grid plates 25, 25' which are axially symmetrical to the center of the opaque insulative substrate 28 are labeled as 252, 252'. The grid plates 251, 251' are electrically interconnected, and the grid plates 252, 252' are electrically interconnected. Similarly, other pairs of column grid plates 25, 25' which are axially symmetrical to the center of the opaque insulative substrate 28 are electrically interconnected.

A single driving system 40 is applied in the double-faced field emission display device. When an emitting voltage is applied between the grid plates 25 and the cathode plates 26, the electron emitters 27 emit electrons. The electrons bombard the fluorescent layer 13, the fluorescent layer 13 luminesces in accordance with the three primary colors, and visible light is emitted from an outer surface of the transparent substrate 11. Thereby, a first image is displayed on the fluorescent screen 10.

Similarly, the electron emitters 27' emit electrons. The electrons bombard the fluorescent layer 13', the fluorescent layer 13' luminesces in accordance with the three primary colors, and visible light is emitted from an outer surface of the transparent substrate 11'. Thereby, a second image the same as the first image is displayed on the fluorescent screen 10'.

Compared with a conventional double-faced field emission display device, the double-faced field emission display device of the present invention adopts a pair of fluorescent screens 10, 10' and a single driving system to simultaneously display same images at the two fluorescent screens 10, 10'. Furthermore, a plurality of grid plates 25, 25' are adopted, so that the emitting voltage is low and the emission of the electrons can be controlled accurately. The double-faced field emission display device of the present invention has a simple structure, small bulk and low cost, and can be advantageously applied in traffic signal boards, large-scale display boards, surround cinemas, and so on.

It is to be understood that the above-described apparatus is intended to illustrate rather than limit the invention. Variations may be made to the apparatus without departing from the spirit of the invention. Accordingly, it is appropriate that the appended claims be construed broadly and in a manner consistent with the scope of the invention.

We claim:

1. A double-faced field emission display device comprising:

two parallel fluorescent screens, each fluorescent screen comprising a transparent substrate with an anode plate and a plurality of fluorescent layers formed in turn at an inner surface of the transparent substrate; and an electron emission structure located between the fluorescent screens, comprising an opaque insulative substrate having two opposite surfaces;

wherein each surface of the opaque insulative substrate has a plurality of cathode plates and a plurality of insulative layers alternately formed thereat, each cathode plate has an electron emitter formed thereon, and each insulative layer has a grid plate formed thereon; and pairs of the cathode plates symmetrically opposite each other across the opaque insulative substrate are electrically interconnected, and pairs of the grid plates symmetrical to the center of the opaque insulative substrate are electrically interconnected.

2. The double-faced field emission display device as claimed in claim 1, wherein when the cathode plates are regarded as row electrodes, the grid plates are regarded as column electrodes, and when the grid plates are regarded as row electrodes, the cathode plates are regarded as column electrodes.

3. The double-faced field emission display device as claimed in claim 1, wherein the electron emitters are made of carbon nanotubes, metal, or one or more semiconductive materials.

4. The double-faced field emission display device as claimed in claim 3, wherein each electron emitter generally faces a corresponding fluorescent layer.

5. The double-faced field emission display device as claimed in claim 1, wherein a single driving system is applied in the double-faced field emission display device.

6. The double-faced field emission display device as claimed in claim 1, wherein the electron emission structure and the fluorescent screens cooperatively define a pair of emitting spaces, and four side walls enclose each emitting space.

7. The double-faced field emission display device as claimed in claim 1, wherein four through holes are defined in four corners of the opaque insulative substrate.

8. The double-faced field emission display device as claimed in claim 1, wherein the fluorescent layers are coated on the anode plate.

9. The double-faced field emission display device as claimed in claim 8, wherein an aluminum film covers the fluorescent layers.

10. A display device comprising:

two viewable screens parallel spaced from each other, each of said two screens comprising at least one first electrifiable plate attached thereto;

a structure located between said two screens and having a plurality of second electrifiable plates with emitters thereon, said second electrifiable plates attached to a first surface and a second surface at two opposite sides of said structure respectively so as to face said at least one first electrifiable plate of said two screens respectively; and a plurality of third electrifiable plates alternately disposed between said plurality of second electrifiable plates at each of said first and second surfaces of said structure, and electrifiable to urge emission from said emitters on said plurality of second electrifiable plates toward said at least one first electrifiable plate so as to lighten said two screens respectively by said emission of said emitters;

wherein each of said plurality of second electrifiable plates attached to said first surface of said structure is electrically connected to one electrifiable plate of said plurality of second electrifiable plates which is attached to said second surface of said structure and is located symmetrically to said each second electrifiable plate attached to said first surface of said structure with respect to a central plane of said structure; and each of said plurality of third electrifiable plates attached to said first surface of said structure is electrically connected to one electrifiable plate of said plurality of third electrifiable plates which is attached to said second surface of said structure and is located symmetrically to said each third electrifiable plate attached to said first surface of said structure with respect to a central point of said structure.

11. A method to perform a double-faced display device, comprising the steps of:

arranging two viewable screens spaced from each other and each of said two screens viewable from a side thereof facing away from each other;

arranging a structure between said two viewing screens, said structure having a plurality of emitters on first and second surfaces thereon, said first and second surfaces facing said two screens respectively, said structure being electrifiable by electrifying a plurality of cathode plates formed on said first and second surfaces, and said two screens being electrifiable respectively by electrifying an anode plate formed thereon;

selectively electrically connecting each of said plurality of cathode plates formed on said first surface of said structure with one another of said plurality of cathode plates formed on said second surface of said structure so that said each and said one another of said plurality of cathode plates are capable of being electrified together;

disposing a plurality of electrodes on said first surface of said structure and said second surface of said structure, and selecting electrically connecting pairs of electrodes symmetrical to a central point of said structure; and electrifying said two screens, said structure and said plurality of electrodes so as to urge electron emission of said plurality of emitters toward said two screens respectively for viewable display thereon by means of said emission.

* * * * *